US006993859B2

(12) United States Patent
Martin et al.

(10) Patent No.: US 6,993,859 B2
(45) Date of Patent: Feb. 7, 2006

(54) SNOWBOARD BOOT WITH LINER HARNESS

(75) Inventors: John Dietrich Martin, Vashon, WA (US); Bobby Meeks, Salt Lake City, UT (US)

(73) Assignee: K-2 Corporation, Vashon, WA (US)

( * ) Notice: Subject to any disclaimer, the term of this patent is extended or adjusted under 35 U.S.C. 154(b) by 173 days.

(21) Appl. No.: 10/729,840

(22) Filed: Dec. 5, 2003

(65) Prior Publication Data

US 2004/0200098 A1 Oct. 14, 2004

Related U.S. Application Data

(63) Continuation-in-part of application No. 10/365,725, filed on Feb. 11, 2003, now Pat. No. 6,877,256.

(51) Int. Cl.
*A43B 5/04* (2006.01)
*A43B 23/28* (2006.01)
*A43B 5/00* (2006.01)

(52) U.S. Cl. ..... 36/50.5; 36/114; 36/117.7; 36/58.5

(58) Field of Classification Search ..... 36/50.5, 36/51, 10, 114, 115, 117.1, 117.6, 117.7, 36/58.5
See application file for complete search history.

(56) References Cited

U.S. PATENT DOCUMENTS 4,513,520 A * 4/1985 Koch ..... 36/10
4,620,378 A * 11/1986 Sartor ..... 36/117.8
4,719,670 A * 1/1988 Kurt ..... 242/395
4,719,709 A * 1/1988 Vaccari ..... 36/50.5
4,937,953 A * 7/1990 Walkhoff ..... 36/50.5
5,005,303 A * 4/1991 Bonaventure et al. ..... 36/50.5
5,319,868 A * 6/1994 Hallenbeck ..... 36/50.1
5,325,613 A * 7/1994 Sussmann ..... 36/50.1
5,351,420 A * 10/1994 Pozzobon et al. ..... 36/50.5
5,412,883 A * 5/1995 Wulf et al. ..... 36/50.5
5,425,185 A * 6/1995 Gansler ..... 36/50.1
5,566,474 A * 10/1996 Leick et al. ..... 36/50.1
5,934,599 A 8/1999 Hammerslag
5,937,542 A 8/1999 Bourdeau
6,202,953 B1 * 3/2001 Hammerslag ..... 36/50.5
6,289,558 B1 * 9/2001 Hammerslag ..... 36/50.5
6,405,457 B1 6/2002 Basso et al.
6,467,193 B1 10/2002 Okajima
6,560,898 B2 * 5/2003 Borsoi et al. ..... 36/10

* cited by examiner

*Primary Examiner*—Anthony Stashick
(74) *Attorney, Agent, or Firm*—Christensen O'Connor Johnson Kindness PLLC

(57) ABSTRACT

A boot (200), such as a snowboard boot, having a harness assembly (240) disposed in an outer shell (210). The harness defines a vamp gap and includes a plurality of cord keepers (268) disposed on either side of the gap. A cord—for example, a stainless steel cable (266)—slidably engages the cord keepers, for tightening the harness about the user's ankle. A tensioning mechanism (190) having a knob (192) is attached to the harness assembly and engages the cable, whereby the user can releasably tension the cable. An aperture (126) in the outer shell is adapted to receive the knob, whereby the user can tighten or loosen the harness without removing the boot. The cable may slidably engage the tongue (215) of the boot, such that tensioning the cable will bias the tongue inwardly, towards the user.

23 Claims, 8 Drawing Sheets

SNOWBOARD BOOT WITH LINER HARNESS

CROSS-REFERENCE TO RELATED APPLICATION

This application is a continuation-in-part of U.S. patent application Ser. No. 10/365,725, filed Feb. 11, 2003 now U.S. Pat. No. 6,877,256, priority to which is claimed, and the disclosures of which are hereby expressly incorporated by reference.

FIELD OF THE INVENTION

The present invention relates generally to sports boots and, more specifically, to a sports boot having an internal harness.

BACKGROUND OF THE INVENTION

Many boots, and particularly boots for sporting applications such as skiing, snowboarding, skating, hiking, and the like, are intended to be worn with a boot liner that fits inside the boot between the boot and the user's foot. The liner may be removable from the boot or permanently attached to the boot. The liner provides many benefits—for example, a liner conforms to the shape of the user's foot, providing a more exact fit between the user and the boot. The liner also helps to keep the user's foot warm, provides padding to the user, absorbs accumulated perspiration and other moisture, and provides a comfortable, snug fit between the user's foot and ankle and the boot. Removable liners have the advantage of being easily cleaned and replaced, as needed. Frequently, liners are provided with a relatively stiff and durable sole portion to protect the liner from excessive wear.

Prior art boot liners may be simply sock-type liners wherein the liner is generally L-shaped and tubular, with sufficient stretchability and flexibility to receive the user's foot. These types of liners can be difficult for the user to put on and take off. Often, a longitudinal vamp comprising a slit and tongue is provided in the liner to facilitate putting on the liner and boot. Conventional liners generally rely on the boot fastening system, e.g., laces and buckles, to provide a comfortably tight fit between the liner and the user. The boot fastening system may not be adequate for achieving the desired fit for the liner, however, because the boot is generally of a much stiffer construction than the liner.

Addressing this need, some prior art boot liners have a conventional vamp portion and separate tightening systems, such as laces or straps. Such laces or straps permit the liner to be fastened about the foot and ankle of the user at a selective tightness. This enables the user to achieve a more comfortable fit. Additionally, this vamp-type construction permits a greater range of options for the material that is used for the liner, since the liner does not have to be as stretchable as a sock-type liner. This greater choice in materials permits the designer greater options in selecting materials that are more suitable to meet the various functions of the liner described above. Such prior art liners, however, have the disadvantage that the user must lace up two sets of footwear, and the user typically cannot adjust the tightness of the liner without first unlacing and/or removing the outer shell to reach the liner lacing. Therefore, if the user determines the liner is too tight or too loose during use of the sports boot—for example, if the liner loosens during use—it may be inconvenient or impractical for the user to adjust the tightness of the liner. This can be especially problematic in snow sports such as skiing and snowboarding, where environmental conditions make it difficult for the user to remove his or her sports boots in situ. The user may also have to remove or loosen snow gaiters to remove the boot shell, further exacerbating the inconvenience. In fact, with prior art liner tightening systems, it is common for the snowboarder to make one or two runs down a slope, and then have to remove the boot shell to retighten the liner, then put the boot shell back on before making another run. This procedure is inconvenient and reduces the amount of time the user has to actually snowboard over any given day.

Lacing systems for boot shells are known that utilize a cord, such as a lace, that is slidably disposed in lace guides such that the lace crisscrosses the boot vamp, and a tightening mechanism having a spool attached to the boot, whereby the tightening mechanism can be easily accessed to tension the lace. For example U.S. Pat. No. 5,934,599, to Hammerslag (which is hereby incorporated by reference), discloses such a lacing system wherein the tightening mechanism is externally disposed on the back of the boot upper. Such systems, however, require a suitable external surface for mounting the tightening mechanism.

There remains a need, therefore, for a boot liner that incorporates a separate tightening system and wherein the liner can be tightened without loosening or removing the associated boot, or without lifting or loosening the snow gaiter or the pants and exposing the boot to the environment.

SUMMARY OF THE INVENTION

A sports boot having an outer shell and adapted for use with an inner liner is disclosed. A mechanism that permits a user to selectively tighten or loosen the fit of the inner liner, without removing the boot, is provided.

In one embodiment, the liner includes a fastener for tightening the liner about the foot and ankle of the user independently of the outer shell. The outer shell includes a relatively rugged sole and an upper that is attached to the sole, the upper having an aperture therethrough. The liner is held in the outer shell. A plurality of cord keepers is attached to the liner, and a fastener is slidably retained by the cord keepers. A tightening mechanism is attached to the liner, engaging the fastener such that the cord can be tensioned to tighten the liner about the user's foot. The tightening device is positioned and sized to extend, at least in part, through the aperture in the outer shell, whereby the user can access the tightening mechanism to adjust the cord tension without removing the outer shell.

In another embodiment of the invention, a harness is disposed within the boot outer shell, the harness including a flexible panel adapted to wrap about a portion of the user's ankle. A fastener, such as a cord, is provided to tighten the harness about a user's ankle. A tensioning mechanism is attached to the harness and engages the cord, such that the cord may be tensioned, thereby tightening the harness about the user's ankle and holding the cord in the tensioned state. The boot outer shell includes an aperture therethrough, and the tightening mechanism extends therethrough, providing the user with access to the tightening mechanism without having to remove the boot.

In an embodiment of the present invention, the tightening mechanism is movable between a first position, wherein the tightening mechanism drivably engages the cord, and a second position, wherein the tightening mechanism does not drivably engage the cord.

In an embodiment of the invention, the outer shell aperture includes a flexible grommet through which at least a portion of the tensioning mechanism extends.

In an embodiment of the invention, the cord is a stainless steel cable.

In an embodiment of the invention, the cord keepers include U-shaped channels for the cord, the U-shaped channels having a relatively large minimum radius.

In an embodiment of the invention, a supplemental cord keeper is attached to the liner, the supplemental cord keeper providing a channel for the cord that is disposed generally about the backside of the liner.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
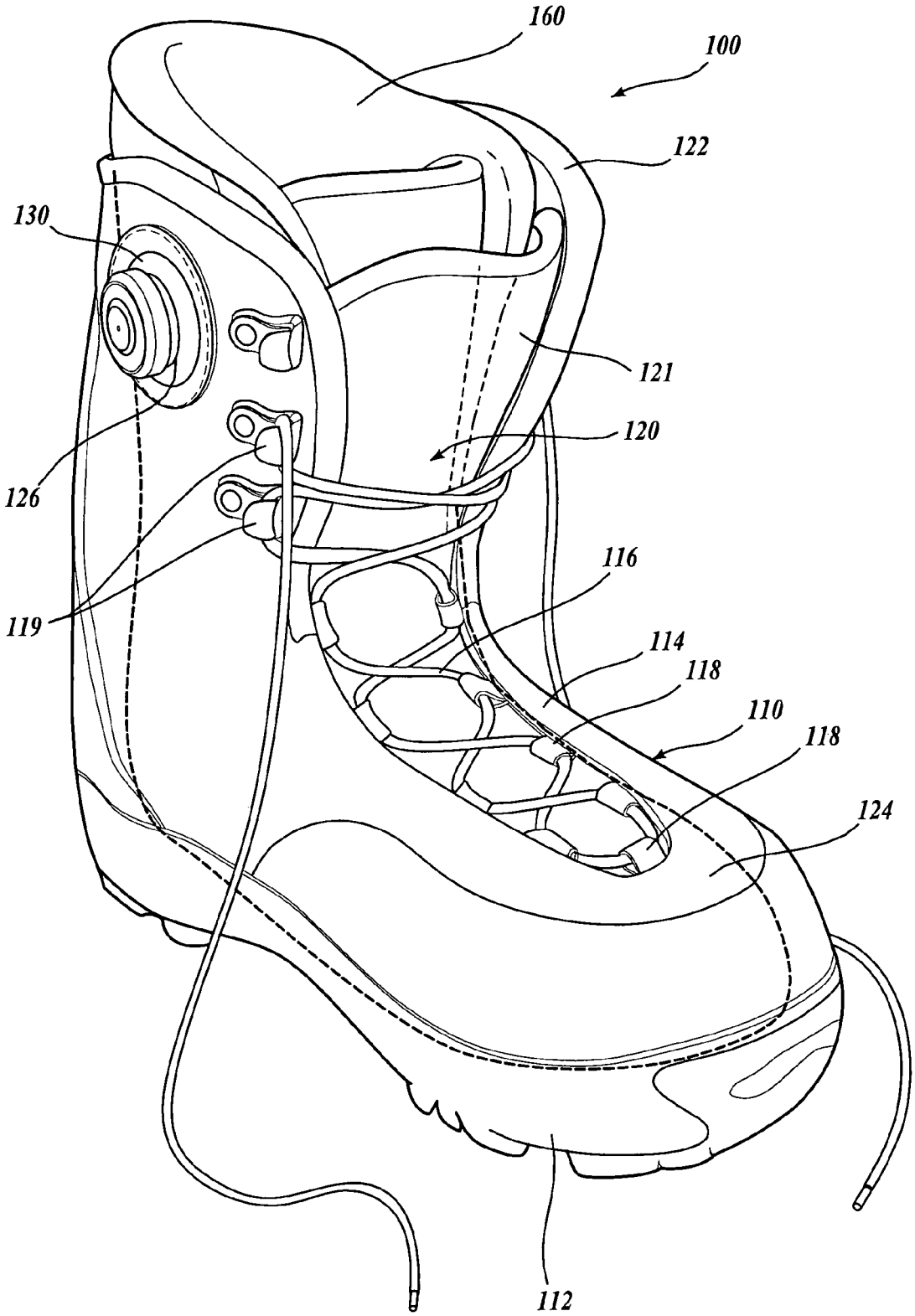
FIG. 1 shows a perspective view of a boot, including a shell and liner, showing a particular embodiment of the present invention.
Figure 2:
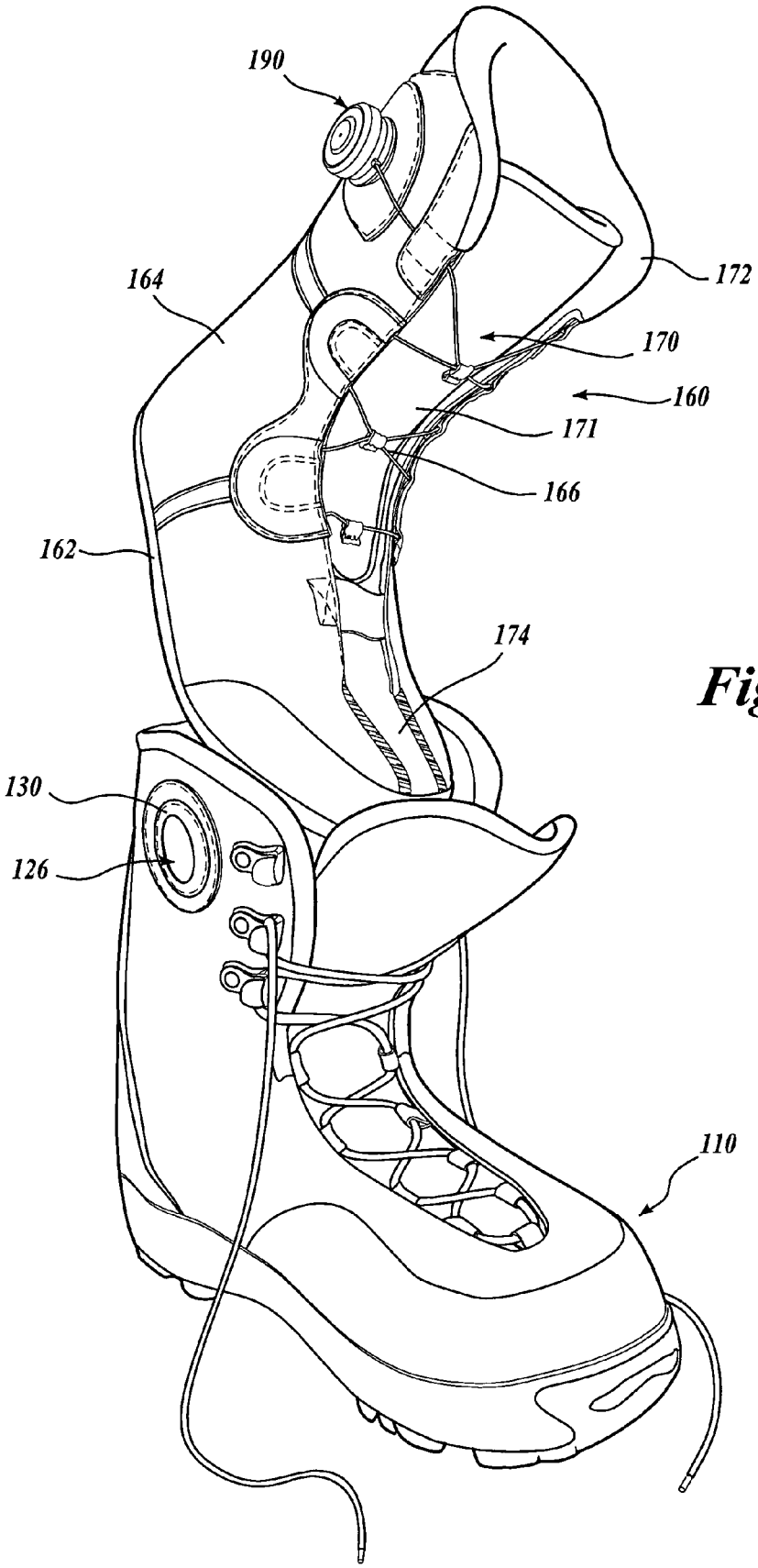
FIG. 2 shows a perspective view of the boot and liner shown in FIG. 1, wherein the liner is positioned for insertion into the boot shell.

Referring now to the figures, wherein like parts are indicated with like numbers, FIGS. 1 and 2 show a sports boot 100 that exemplifies the present invention. The sports boot 100 has an outer shell 110 and a removable liner 160. It will be appreciated that although a removable liner is described herein, the invention is not intended to be limited to removable liner embodiments. The outer shell 110 of the sports boot 100 includes a rugged sole 112 and a relatively flexible upper 114 attached to the sole 112. The attachment of the upper 114 to the sole 112 may be accomplished in any number of ways as is well known in the art—including, for example, by bonding, sewing, attachment hardware, or co-forming. It will be appreciated that the selection of such attachment options may depend on the particular application that the sports boot is designed to accommodate, such as skating, skiing, snowboarding, hiking, and the like.

The upper 114 includes an elongate gap 120 that extends from a top end 122 of the upper 114, through a substantial portion of the length of the upper 114 towards the toe end 124. A tongue 121 is attached near the base of the elongate gap 120 and disposed generally along the elongate gap 120. In the disclosed embodiment, the upper 114 is intended to be tightenable about a received user's foot (not shown), using a cord 116, such as a cable or lace, that is slidably disposed within a plurality of opposed cord keepers 118, 119. Although cord keepers made as fabric loops 118 and metal hooks 119 are shown in the disclosed embodiment, it will be appreciated that any number of different cord keepers might also be selected. Some floating cord keepers may also be provided. As used in this application, "cord" refers to any elongate, flexible lace, cable, strip, or the like, that is used as a tensioning element for the sports boot, and may be made from any suitable material, including leather, metal (such as stainless steel), cloth, plastic, etc. In the preferred embodiment, the cord 116 is a conventional fabric lace. It will be appreciated that alternate or additional securing mechanisms may be used for tightening the outer shell 110, including, for example, straps and buckles, hook-and-hoop type fasteners, an external cable system and the like.

An aperture assembly 126 is provided near the top end 122 of the upper 114, with an elastic grommet 130 attached thereto. The purpose and exemplary structure for the aperture assembly 126 and grommet 130 are discussed below.

As seen most clearly in FIG. 2, the liner 160 is adapted to be removably inserted into the outer shell 110. In the disclosed embodiment, the liner 160 includes a flexible and relatively rugged sole 162 and a relatively soft and flexible upper 164. The sole 162 may be made of any suitable material, including, for example, a polymer such as an ethylene-vinyl acetate copolymer or similar polymer. It may be desirable to texture the bottom of the sole 162, for example, by providing a plurality of nibs (not shown) or other short projections, to discourage relative sliding between the liner sole 162 and boot shell 110 during use. The padded upper 164 may be attached to the sole 162 in any conventional manner, including, for example, by stitching, bonding, or co-forming.

The padded upper 164 is intended to provide a snug fit, comfort, protection, moisture dispersal, and shock absorption for the user, and therefore suitable flexible materials as are well known in the art may be used to construct the upper 164, including, for example, natural and man-made fibers, leather, padding materials, and combinations thereof. It will be appreciated that the upper 164 may be a composite structure having several layers, and that the various layers may be selected to provide different functions. For example, a soft inner layer may be used for comfort, while a relatively stiff outer lay may be used to provide support and durability. Partial layers, such as leather or polymeric strips, may be attached to provide strength and/or support in desired locations. The liner upper 164 includes an elongate gap 170 extending from near the top end 172 of the liner 160 down towards the toe end 174. A tongue 171 is provided that extends generally along the length of the elongate gap 170.

Figure 3:
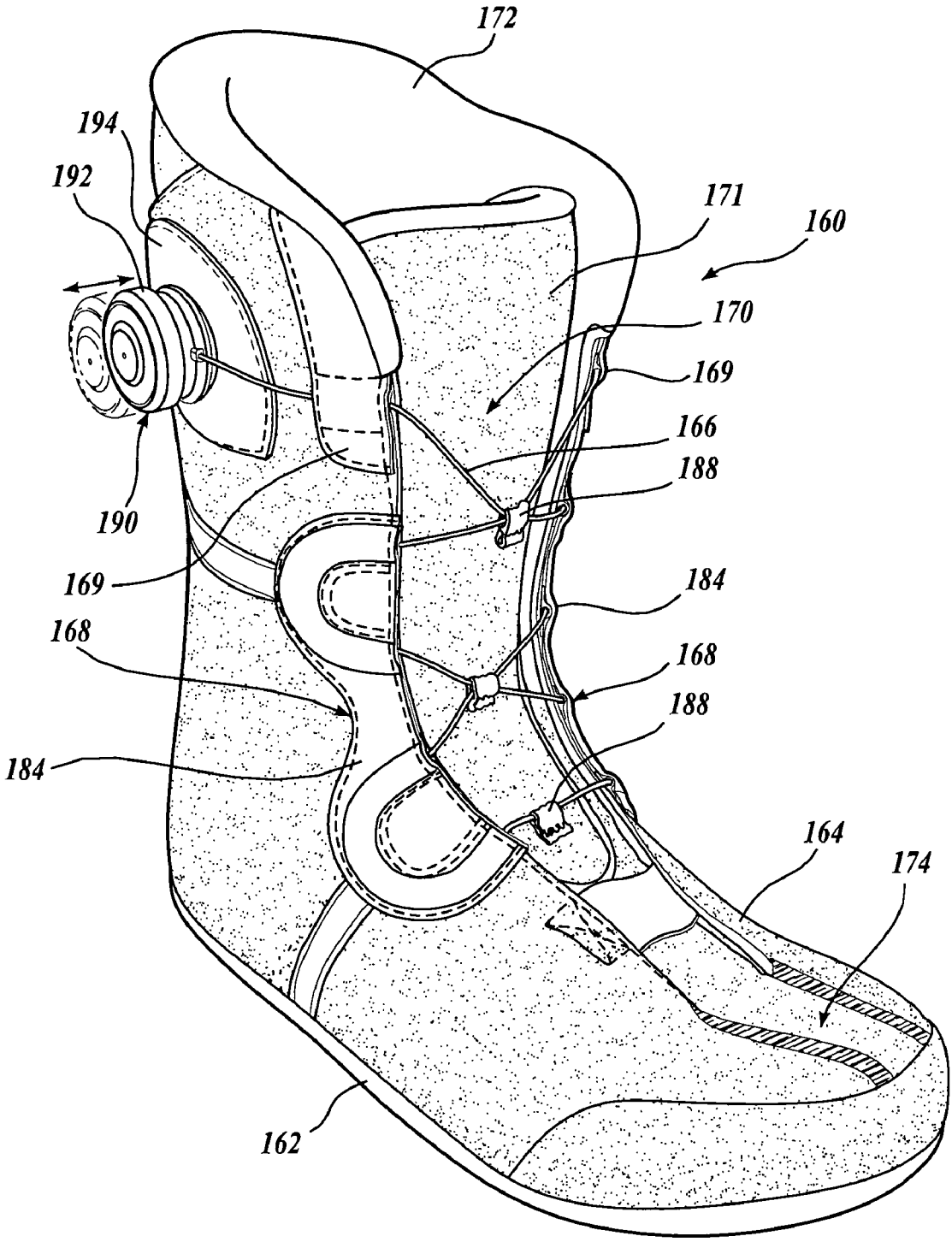
FIG. 3 shows an isolated perspective view of the liner shown in FIG. 1.
Figures 4A, 4B:
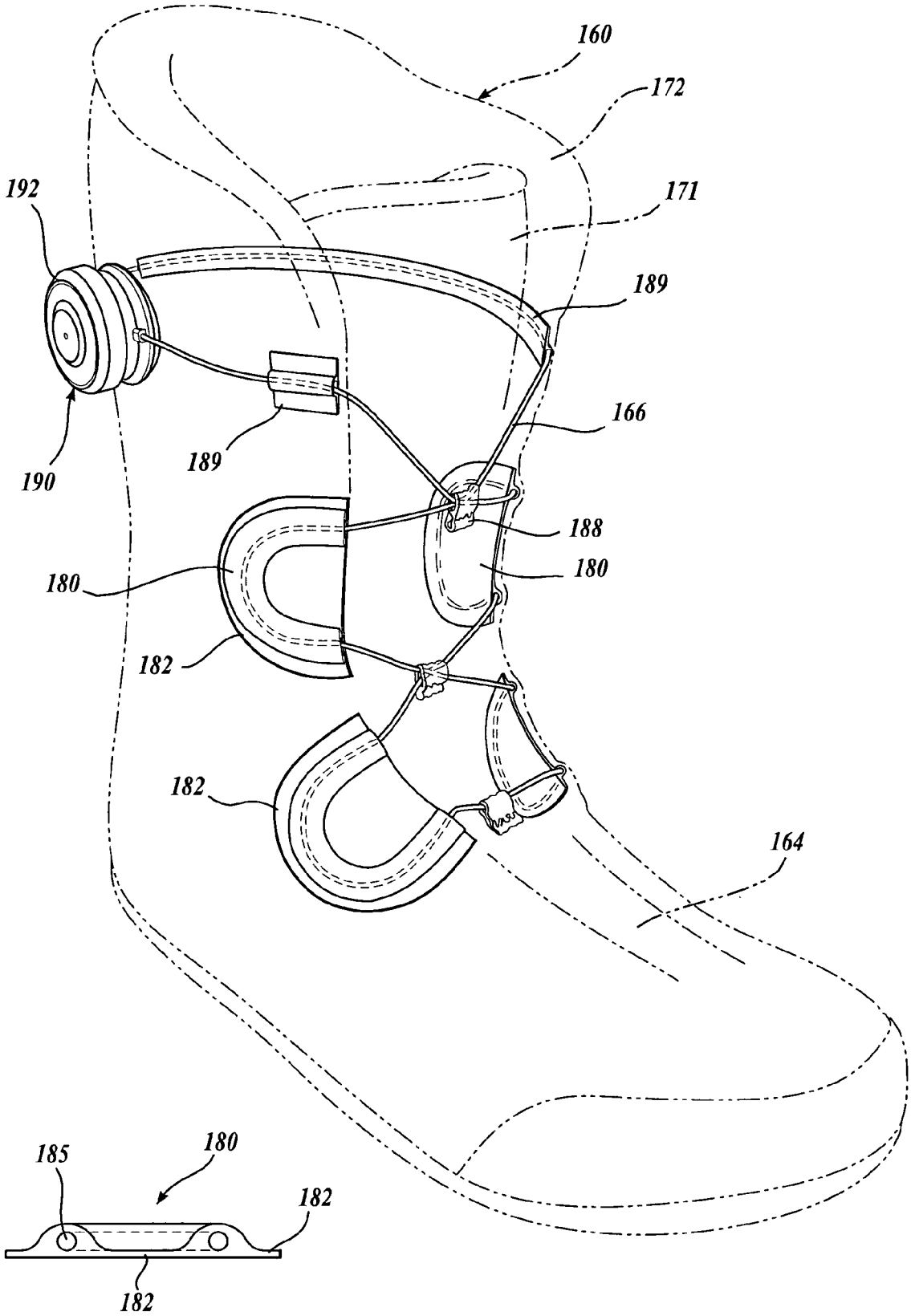
FIG. 4A shows the lacing system for the liner shown in FIG. 3, with the liner shown in phantom.
FIG. 4B shows a cross section of the liner cord keeper tubular member, for the liner shown in FIG. 3.

Referring now to FIGS. 3 and 4, which show details of the liner 160, a plurality of opposed cord keepers 168 is attached to the liner 160 on opposite sides of the elongate gap 170. The presently preferred cord keepers 168 may include a low-friction plastic tubular member 180 (See FIGS. 4A and 4B) having a transverse flange 182, and defining a generally U-shaped channel 185 adapted to slidably receive a cord 166. The tubular members 180 are attached to the liner 160, preferably with a leather panel 184 stitched over the tubular member 180, although it will be apparent that any suitable attachment systems may alternatively be used. It will be appreciated that the cord keepers 168 and, in particular, the tubular members 180, define generally U-shaped channels 185 (FIG. 4B) having a relatively large minimum radius on the "U" portion.

A cord 166 slidably engages the cord keepers 168, crisscrossing the elongate gap 170. In the disclosed embodiment, the cord 166 is a stainless steel cable having a low coefficient of friction with respect to the tubular members 180, whereby the cord 166 will slide relatively freely in the cord keepers 168. It should be appreciated, however, that the cord may be made from any suitably strong and flexible materials, including other metal cables, composite materials, fabrics and the like. The relatively large minimum radius defined by the U-shaped channels 185 in the cord keepers 168 also help to reduce frictional binding of the cord 166 in the channel 185. In the disclosed embodiment, a two-piece supplemental cord keeper 169 is provided that extends generally around the upper back portion of the upper 164. The two-piece supplemental cord keeper 169 is similar in construction to the cord keepers 168 previously described, including a flanged tubular member 189. The supplemental cord keeper 169 provides a low-friction channel for the cord 166 to wrap behind the liner 160. In the disclosed embodiment, a plurality of fabric loops 188 is attached to the tongue 171, generally along its longitudinal centerline. The crisscrossing cord 166 engages the loops 188, thereby holding the tongue 171 in the desired position.

FIG. 4B shows an end view of the tubular member 180, showing the flanges 182. It will be appreciated that the flanges provide a relatively broad, flat surface for attachment of the tubular members 180 to the liner 160. The flanges 182 preferably extend across the tubular member 180, as shown, to maintain the desired orientation of the legs of the U-shaped channels 185.

A tightening mechanism 190 is attached to the liner 160, preferably near the top end 172 of the upper 164. The tightening mechanism 190 is preferably a gear-driven spool mechanism as is known in the art—for example, the spool mechanism disclosed in U.S. Pat. No. 5,934,599, which has been incorporated herein by reference. The tightening mechanism 190 includes a rotatable knob 192 that projects generally away from the liner 160. As indicated by the broken lines and arrows in FIG. 3, the knob 192 can be moved between an inwardly-disposed first position, wherein the knob 192 drivably engages the tightening mechanism 190, and an outwardly-disposed second position, wherein the tightening mechanism 190 is not engaged. The tightening mechanism 190 includes an internal spool (not shown) that is functionally attached to both ends of the cord 166, whereby rotation of the spool will cause the cord 166 to wind around (or unwind from) the spool.

When the knob 192 is in the first position to drivably engage the tightening mechanism 190, rotating the knob 192 will cause the spool to rotate, thereby enabling the user to selectively apply a tension to the cord 166. An integral locking mechanism, as is well known in the art, restricts the spool to rotating in one direction only when the knob 192 is in the first position. It will now be appreciated that the user can achieve the desired tightening of the liner 160 by placing the knob in the first position and rotating the knob 192 until the desired tightness is achieved. The low frictional resistance between the cord 166 and the cord keepers 168, 169 help to ensure that the tension in the cord 166 is relatively uniform along the length of the cord 166. The user may pull the knob 192 outwardly to the second position to release the tension on the cord 166

The tightening mechanism 190 may be attached to the outer surface of the liner 160, for example, by stitching a panel, such as a leather panel 194 (See FIG. 3), over a flange (not shown) on the tightening mechanism 190. Other suitable attachment mechanisms may alternatively be used such as those delineated above, and are contemplated by the present invention. It will be appreciated that the tightening mechanism 190 is preferably relatively thin, and is attached to the liner 160 in a manner that precludes causing discomfort to the user, e.g., outside the padded portion of the liner 160.

Referring again to FIGS. 1 and 2, the boot shell 110 is provided with an aperture assembly 126, including an elastic grommet 130, that is positioned to removably receive the tightening mechanism 190 when the liner 160 is properly inserted into the boot shell 110. The boot shell 110 is sufficiently flexible to permit the liner 160, including the tightening mechanism 190, to be inserted into the boot shell 110 when the outer shell lace 116 is untightened. It will be apparent that, although the aperture assembly 126 of the disclosed embodiment incorporates a closed aperture and grommet assembly, other configurations are possible and contemplated by the present invention. For example, the aperture may be open at the top, forming a slot in the boot shell that slidably accommodates the tightening mechanism 190. Similarly, a closable aperture, such as a slot having a strap, or some other fastening mechanism that is releasably engageable to close the open top of the aperture may be provided. The term "aperture" as used herein is intended to encompass such alternate constructions.

Figure 5:
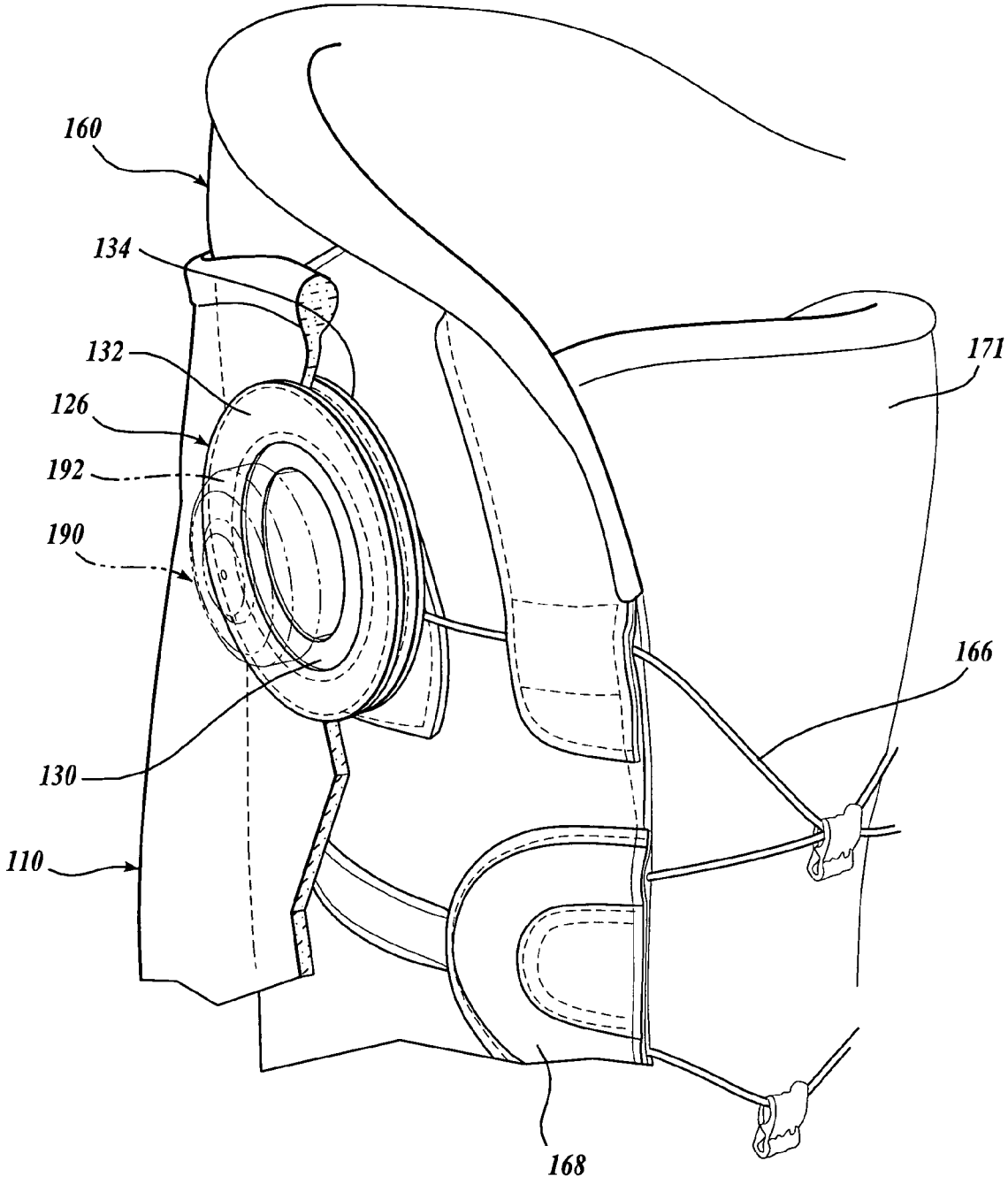
FIG. 5 shows a fragmentary view of the outer shell aperture assembly for the liner tightening mechanism of the boot shown in FIG. 1.

FIG. 5 shows a fragmentary view of the boot shell 110 and liner 160, showing the aperture assembly 126, including the grommet 130 of the exemplary embodiment. In the preferred embodiment, the aperture assembly 126 comprises an annular leather outer panel 132 disposed on the outer surface of the shell 110 over an aperture in the shell 110, and an annular elastic inner panel 134 disposed on the inner surface of the shell 110, concentrically disposed with respect to the outer panel 132. The inner and outer annular panels 132, 134 are preferably stitched to the boot shell 110. The elastic inner panel 134 may be made of any suitably elastic material, such as a thermoplastic rubber, and has a smaller inner radius than the outer panel 132, such that a portion of the inner panel 134 extends inwardly further than the outer panel 132, forming the grommet 130. The grommet 130 is adapted to receive the knob 192 of the tightening mechanism 190 by flexing sufficiently to permit the tightening mechanism to pass through the inner aperture of the inner panel 134. This structure provides a relatively tight, weather-resistant seal between the tightening mechanism 190 and the boot shell 110.

It will be obvious to one of ordinary skill in the art that other similar structures may be utilized to permit the tightening mechanism 190 to be accessible externally from the shell 110. For example, a slot may be provided on the shell 110 to receive the tightening mechanism, or a fastenable strap, such as a hoops-and-hooks type strap, may be provided to open an aperture for the tightening mechanism. Other equivalent structures will be readily apparent and are contemplated by the present invention. Similarly, the aperture may be located in a different location on the shell 110 (with a compatible change to the liner 110) without departing from the present invention.

It will also be apparent to one of skill in the art that although the disclosed embodiment tightens the liner generally along the entire length of the vamp portion of the liner, the invention could also be applied to a heel harness, i.e., to tightening only about the user's heel area in order to reduce heel lift, which is a common problem associated with snowboarding.

It should now be appreciated that the disclosed boot 100 includes an externally accessible tightening mechanism 190 for the tightening apparatus of the inner liner 160. This system permits the user to tighten or loosen the fit of the liner 160 about the user's foot without removing or loosening the outer shell 110. In the disclosed embodiment the tightening mechanism is conveniently disposed near the top of the boot 100, on the lateral or outer side of the user, for easy access. Moreover, the liner may be easily removed from the outer shell 110 for easy cleaning, drying, maintenance, or replacement, if desired.

Figure 6:
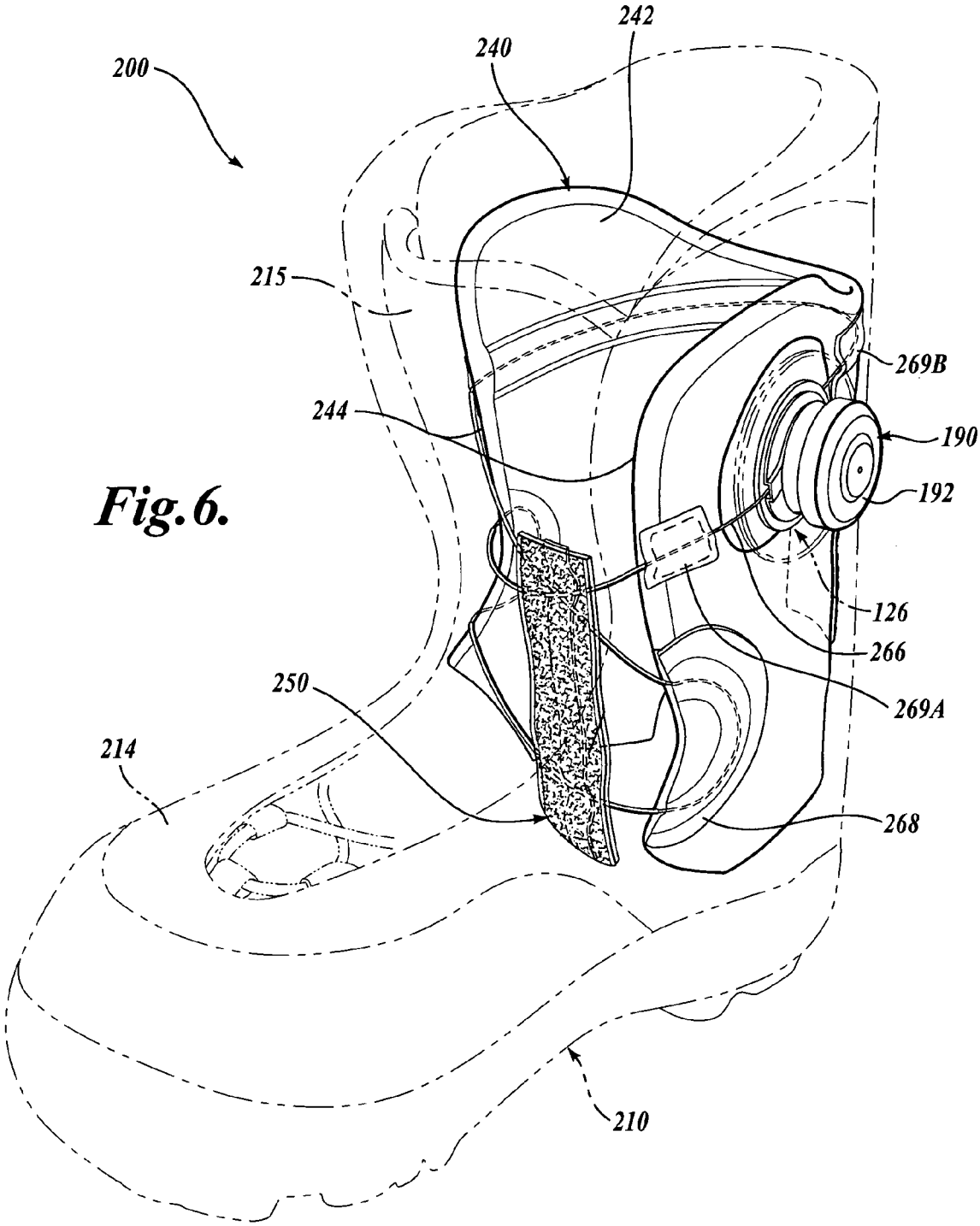
FIG. 6 is a perspective view of a second embodiment of a sports boot, constructed according to the present invention and utilizing a harness disposed in the boot shell, wherein the boot shell is shown in phantom.
Figure 7:
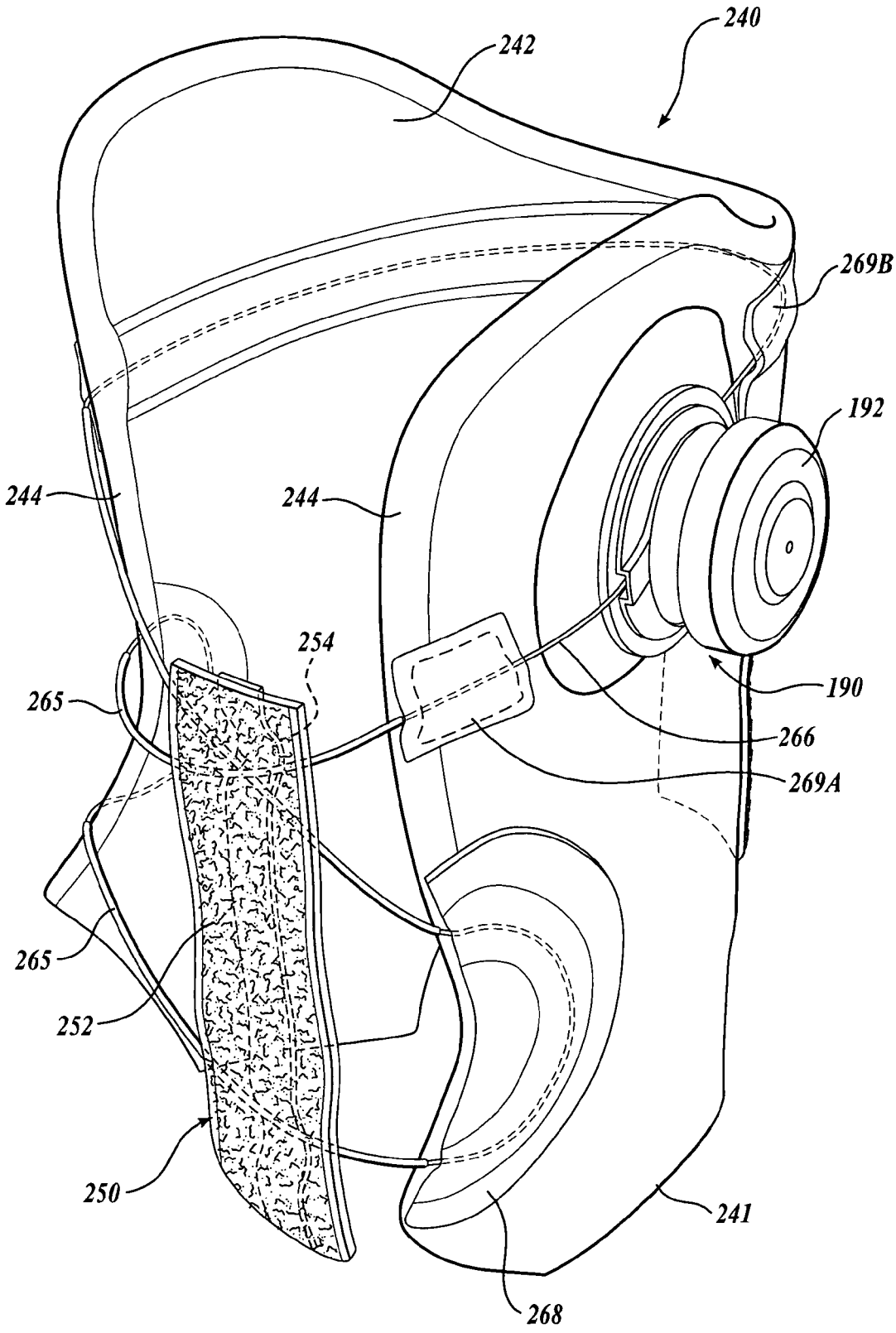
FIG. 7 is a perspective view of the harness shown in isolation, for the snowboard boot shown in FIG. 6.
Figure 8:
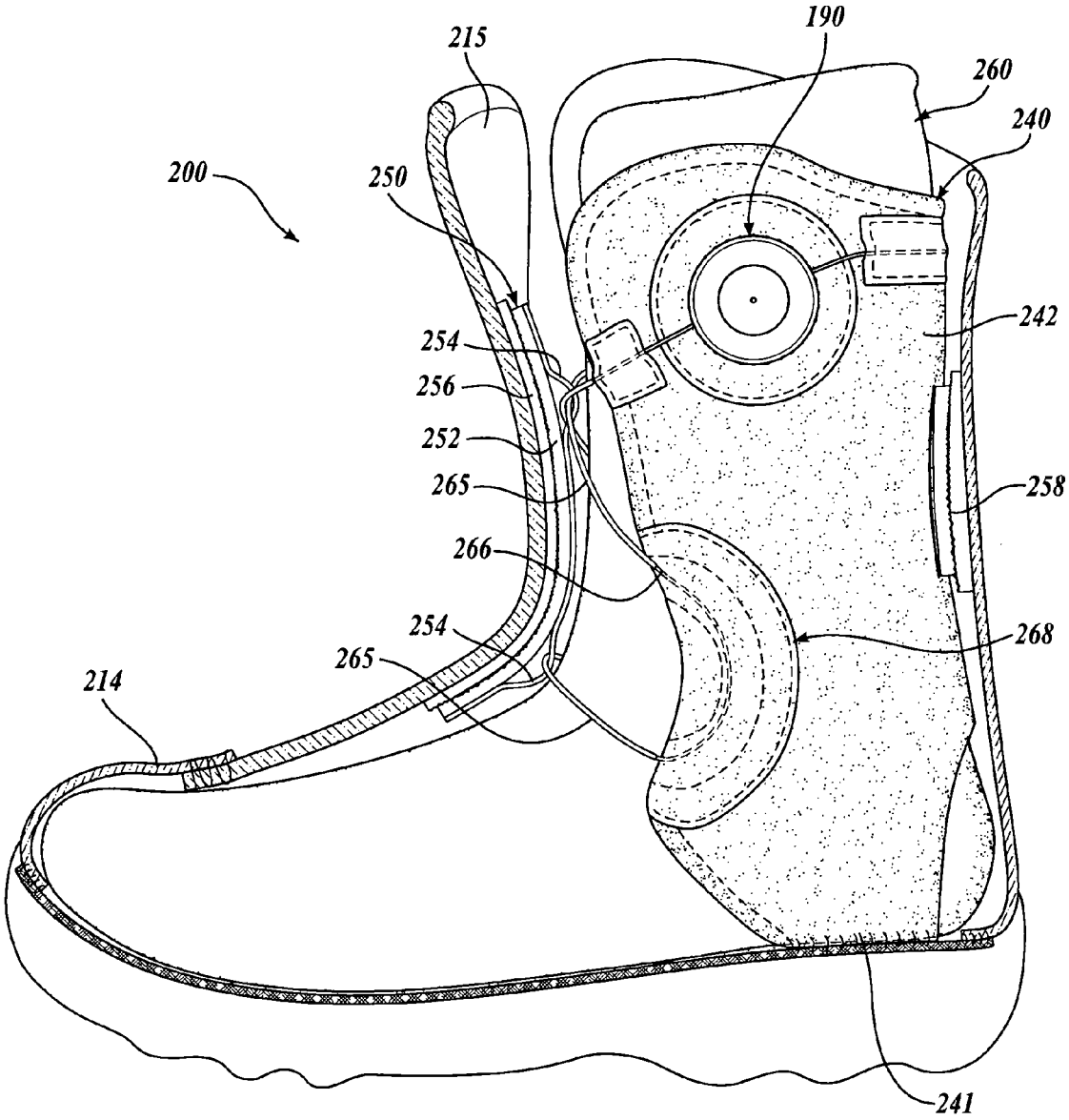
FIG. 8 is a partially cut-away side view of the snowboard boot including a harness, shown in FIG. 6.

An alternative embodiment of the present invention is shown in FIGS. 6–8. FIG. 6 shows a perspective view of a sports boot 200, such as a snowboard boot, with a boot shell 210 shown in phantom and an internal harness assembly 240 disposed generally within the boot shell 210, and having a tightening mechanism 190 that extends through the flexible upper 214 of the boot shell 210. FIG. 7 shows the harness assembly 240 in isolation. The harness assembly 240 includes a flexible panel 242 that is adapted to wrap generally about a portion of the user's ankle (not shown).

The flexible panel 242 defines an elongate vamp gap between opposing edges 244, such that pulling the opposing edges 244 toward each other will tighten the flexible panel 242 about the user's ankle. A pair of opposing, generally U-shaped cord keepers 268 (left side shown) that may be substantially the same as the cord keepers 168 described for the first embodiment above, are attached to the flexible panel 242. Additionally, a two-piece supplemental cord keeper 269A, 269B that wraps about the back side of the flexible panel 242 substantially the same as the supplemental cord keeper 169 described above, is also attached near an upper edge of the flexible panel 242.

A cord 266, preferably a stainless steel cable-type cord, extends through the cord keepers 268, 269A, 269B, generally across the gap between opposing upright edges 244 and around the back side of the panel 242. As seen most clearly in FIG. 7, in the preferred embodiment a plurality of tubular sheaths 265 is slidably disposed about the portions of the cord 266 partially spanning the gap between the opposing edges 244 of the flexible panel 242. The sheaths 265 provide a low-friction channel for the cord 266 to slide in, protect the cord 266 from the elements, and eliminate rubbing between the cord 266 and other portions of the boot 200.

The tightening mechanism 190 is fixedly attached to the flexible panel 242 and receives the cord 266, whereby the cord 266 may be tensioned to secure the harness assembly 240 snugly about the user, as described above. In particular, the tightening mechanism 190 includes a rotatable knob 192 that can be moved between an inwardly-disposed first position wherein the knob 192 drivably engages the tightening mechanism 190, and an outwardly-disposed second position wherein the tightening mechanism 190 is not engaged (see FIG. 3). As shown in phantom in FIG. 6, and similar to the construction shown in FIGS. 2 and 5, the flexible upper 214 includes an aperture assembly 126 that accommodates at least a portion of the tightening mechanism 190, such that the rotatable knob 192 extends through the aperture assembly 126 and is accessible to the user without the user having to take off the boot 200.

When the knob 192 is in the first position to drivably engage the tightening mechanism 190, rotating the knob 192 will allow the user to selectively apply a tension to the cord 266. Pulling the knob to the second position allows the user to release the cord tension. Low frictional resistance between the cord 266 and the cord keepers 268, 269A, 269B help to ensure that the tension in the cord 266 is relatively uniform along the length of the cord 266. The tightening mechanism 190 is attached to the outer surface of the flexible panel 242, for example, by stitching or other suitable attachment methods.

In the disclosed embodiment, the cord 266 also engages the tongue 215 of the upper 214. For example, an engagement strip 250 is provided, having a front side with a releasable fastening element 252 such as a hook and loop type material, and a back side having one or more cord keeper 254 (two shown) that slidably engage the cord 266 and sheaths 265. As seen most clearly in FIG. 8, which shows a cross section side view of the boot shell 210, and the harness assembly 240 wrapped about a conventional liner 260, the tongue 215 of the upper 214 includes a releasable fastening element 256 such as a complementary hook-and-loop type material, that releasably engages the engagement strip 250. It will be appreciated that when the cord 266 is tightened using the tightening mechanism 190, the tongue 215 will be pulled or biased toward the liner 260 by the cord 266, further providing a comfortably snug fit about the liner 260.

In the disclosed embodiment, the rearward portion of the harness assembly 240 and the inner, rearward portion of the flexible upper 214 also are releasably connected, for example, with a second pair of hook-and-loop type fastener 258. The use of releasable fasteners 252, 256, 258 permit the user to adjust the position of the harness assembly 240 within the boot 200, while also precluding undesirable sliding between the harness assembly 240 and the flexible upper 214. The flexible panel 242 may also be fixedly attached to the boot, for example by stitching along a lower edge 241 of the flexible panel 242, whereby the desired general position of the harness assembly 240 is maintained.

To use the boot 200 of the present invention, a user simply inserts a foot, which may already be covered with a conventional liner 260 (or the liner 260 may be pre-inserted into the boot) into the boot 200, and rotates the knob 192 to tighten the harness about the user's ankle. The boot 200 may then be separately laced up. During use, the user may desire to tighten or loosen the harness assembly 240, either for comfort reasons or for performance reasons. This can be done simply, without removing the boot 200, by either further tightening, or releasing tension, using the tightening mechanism knob 292 as described above. When the user desires to remove the boot 200, after loosening the boot laces, the user may simply pull the knob 192 outwardly, then pull outwardly on the boot tongue 215, to release the tension in the cord 266, and pull the cord 266 away from the vamp, allowing the user to easily take off the boot 200.

It will be appreciated that this second embodiment of the present invention may be modified in a straightforward manner without departing from the present invention. For example, cord keepers may be fixedly attached to the tongue 215 of the boot upper 214, rather than using a releasable fastener. The harness assembly may not be fixedly attached to the boot 200 at any point, whereby the entire assembly may be removable from the boot 200—for example, for cleaning or replacement.

This second embodiment of the present invention allows the boot 200 to be used with a conventional liner 260, and in particular, allows the user to easily replace a liner 260, without replacing the relatively expensive tightening mechanism 190. In addition, the tightening mechanism 190 engages the tongue 215 of the boot 200, thereby improving the connection between the user, the liner 260, and the boot 200. These, and other advantages, will be apparent to persons of skill in the art.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A sports boot adapted to receive a user's foot and ankle, the sports boot comprising:

an outer shell having a semirigid sole and a flexible upper attached to the sole, the upper having an aperture therethrough;

a harness disposed within the outer shell, the harness including a flexible panel adapted to wrap about a portion of the user's ankle;

a cord slidably engaging the harness and adapted to tighten the harness about a user's ankle; and a tightening mechanism attached to the harness, the tightening mechanism drivably engaging the cord such that the user can tension the cord, the tightening mechanism adapted to hold the cord substantially at the applied tension;

wherein the tightening mechanism includes a knob that extends through the aperture in the upper when the harness is held within the outer shell.

2. The sports boot of claim 1, further comprising a liner that is removably insertable into the outer shell.

3. The sports boot of claim 1, wherein the cord extends around a rearward portion of the harness.

4. The sports boot of claim 1, wherein the cord is a stainless steel cable.

5. The sports boot of claim 1, wherein the harness defines an elongate vamp gap and includes at least one pair of cord keepers fixedly attached to the harness on opposite sides of the elongate vamp gap, wherein the cord keepers each define a U-shaped channel that slidably receives the cord.

6. The sports boot of claim 5, further comprising an elongate cord keeper that extends around a back portion of the harness.

7. The sports boot of claim 1, wherein the tightening mechanism comprises a knob that is movable between a first position wherein the knob drivingly engages the cord, and a second position wherein the knob does not drivably engage the cord.

8. The sports boot of claim 1, further comprising an elastic grommet disposed in the outer shell aperture, the grommet having a center hole adapted to releasably receive a portion of the tightening mechanism.

9. The sports boot of claim 8, wherein the grommet is made from a thermoplastic rubber.

10. The sports boot of claim 3, wherein the outer shell upper includes a tongue, and the cord slidably engages the tongue such that tightening the cord will bias the tongue inwardly.

11. The sports boot of claim 10, wherein the harness is releasably attached to the outer shell upper.

12. A snowboard boot comprising:

an outer shell having a relatively rigid sole portion, and a flexible upper portion, the flexible upper portion including an aperture therethrough;

a harness assembly having a flexible panel disposed in the outer shell and adapted to wrap about a portion of the ankle of a user, the flexible panel defining a pair of opposed ends and having a plurality of cord guides attached thereto;

a tightening mechanism having a cord that extends between the opposed ends of the flexible panel, the cord slidably engaging the cord guides, and wherein the tightening mechanism is adapted to tension the cord, the tightening mechanism including a rotatable knob portion that extends through the aperture in the outer shell.

13. The snowboard boot of claim 12, wherein the cord is a stainless steel cable.

14. The snowboard boot of claim 13, wherein the outer shell further comprises a tongue portion, and further, wherein the cord slidably engages the tongue portion.

15. The snowboard boot of claim 14, wherein the cord slidably engages the tongue through a cord keeper attached to a strap that releasably attaches to the tongue portion.

16. The snowboard boot of claim 14, further comprising a plurality of sheaths that is slidably disposed about a portion of the cord.

17. The snowboard boot of claim 14, wherein the harness assembly is fixedly attached to the outer shell.

18. A boot for receiving a user's foot and ankle, the sports boot comprising:

an outer shell having a sole fixedly attached to an upper, the upper having a high-top portion including an aperture therethrough;

a harness assembly including a flexible panel adapted to wrap about at least a portion of the user's ankle, a plurality of cord keepers attached to the flexible panel, and a cord slidably retained by the cord keepers;

a tightening mechanism attached to the flexible panel, and disposed to extend through the aperture in the high-top portion, the tightening mechanism engaging the cord to allow the user to selectively tension or de-tension the cord.

19. The boot of claim 18, wherein the cord includes a stainless steel cable.

20. The boot of claim 19, wherein the outer shell further comprises a tongue portion, and further wherein the cord slidably engages the tongue portion.

21. The boot of claim 20, wherein the cord slidably engages the tongue through a cord keeper attached to a strap that releasably attaches to the tongue portion.

22. The snowboard boot of claim 21, further comprising a plurality of sheaths that are slidably disposed about a portion of the cord.

23. The snowboard boot of claim 21, wherein the harness assembly flexible panel is fixedly attached to the outer shell.

* * * * *

UNITED STATES PATENT AND TRADEMARK OFFICE

CERTIFICATE OF CORRECTION

PATENT NO. : 6,993,859 B2
APPLICATION NO. : 10/729840
DATED : February 7, 2006
INVENTOR(S) : J.D. Martin et al.

It is certified that error appears in the above-identified patent and that said Letters Patent is hereby corrected as shown below:

| COLUMN | LINE | |
|---|---|---|
| 10 (Claim 12, line 9) | 9 | "thereto;" should read --thereto; and-- |
| 10 (Claim 16, line 2) | 26 | "that is" should read --that are-- |
| 10 (Claim 18, line 9) | 38 | "keepers;" should read --keepers; and-- |
| 10 (Claim 22, line 1) | 52 | "snowboard boot" should read --boot-- |
| 10 (Claim 23, line 1) | 55 | "snowboard boot" should read --boot-- |

Signed and Sealed this

Twenty-first Day of October, 2008

JON W. DUDAS
*Director of the United States Patent and Trademark Office*